United States Patent [19]

Robertson

[11] Patent Number: 4,781,328

[45] Date of Patent: Nov. 1, 1988

[54] ROTATING STREAM NOZZLE

[75] Inventor: David E. Robertson, Covina, Calif.

[73] Assignee: Rain Bird Consumer Mfg. Corp., Glendora, Calif.

[21] Appl. No.: 30,082

[22] Filed: Mar. 26, 1987

[51] Int. Cl.[4] ..... B05B 3/06

[52] U.S. Cl. ..... 239/230; 239/205; 239/206; 239/241; 239/DIG. 1

[58] Field of Search ..... 239/230, 246, 252, 260, 239/204, 205, 206, 232, 241, 382, 383, 504, DIG. 1

[56] References Cited

U.S. PATENT DOCUMENTS

| | | | |
|---|---|---|---|
| 1,742,898 | 1/1930 | Buelna | 239/230 |
| 2,909,325 | 10/1959 | Hunter | 239/206 |
| 2,955,765 | 10/1960 | Farmer et al. | 239/DIG. 1 |
| 2,990,120 | 6/1961 | Reynolds | 239/230 |
| 3,515,351 | 6/1970 | Costa | 239/206 |
| 3,702,173 | 11/1972 | Reynolds | 239/204 |
| 3,715,078 | 2/1973 | Reynolds | 239/230 |
| 3,771,723 | 11/1973 | Ray | 239/230 |
| 3,874,588 | 4/1975 | Flynn | 239/230 |
| 3,930,618 | 1/1976 | Lockwood | 239/230 |
| 4,493,458 | 1/1985 | Bron | 239/230 |
| 4,687,139 | 8/1987 | Lockwood | 239/206 |

*Primary Examiner*—Andres Kashnikow
*Assistant Examiner*—Michael J. Forman
*Attorney, Agent, or Firm*—Kelly, Bauersfeld & Lowry

[57] ABSTRACT

A rotating stream nozzle is provided particularly for use as an irrigation sprinkler, wherein the nozzle provides a plurality of outwardly directed and discrete water streams which are rotated in steps through a prescribed arcuate spray path. The rotating stream nozzle is adapted for mounting onto a water supply conduit and includes a swirl plate through which water under pressure flows with a swirling action into a relatively small drive chamber. The swirling water flow forces a drive ball within the drive chamber to move into repetitious impact engagement with raised anvils formed on the inner diameter surface of a cylindrical rotor lining the drive chamber and mounted for rotation within a nozzle cap. The rotor is displaced through a small rotational step each time the drive ball strikes one of the anvils, and the water is discharged from the nozzle as discrete rotating streams passing through small discharge ports in the rotor. An open window in the nozzle cap permits outward projection of some of the water streams within the prescribed arcuate path.

28 Claims, 3 Drawing Sheets

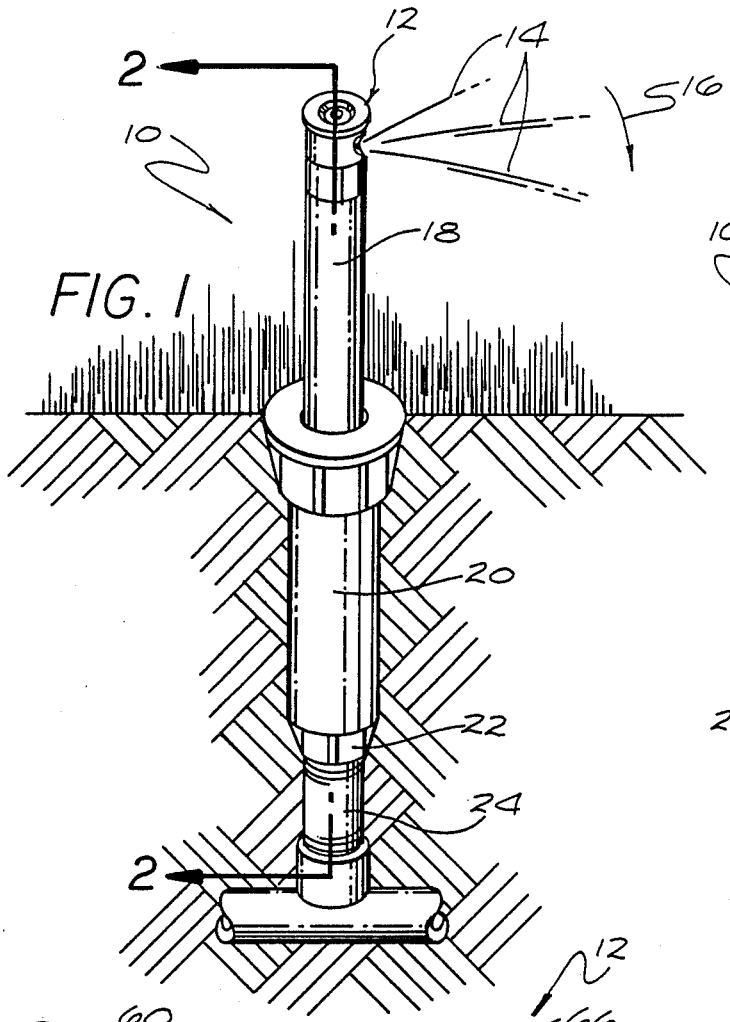
FIG. 1
FIG. 2
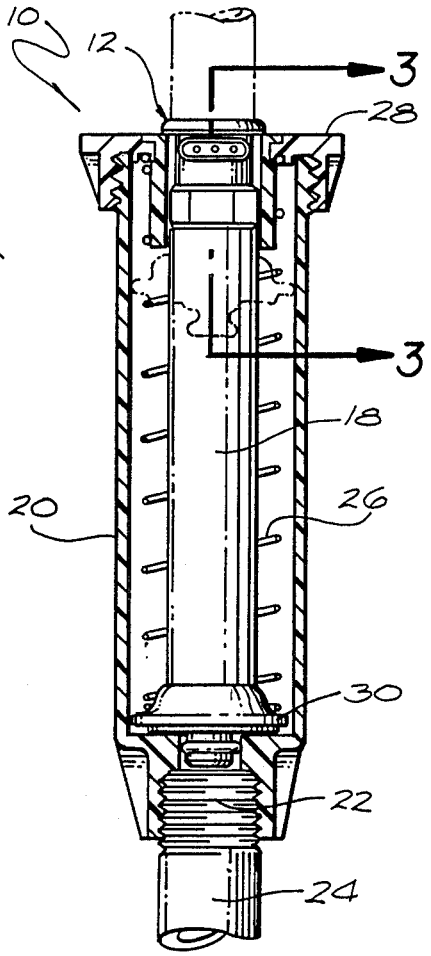
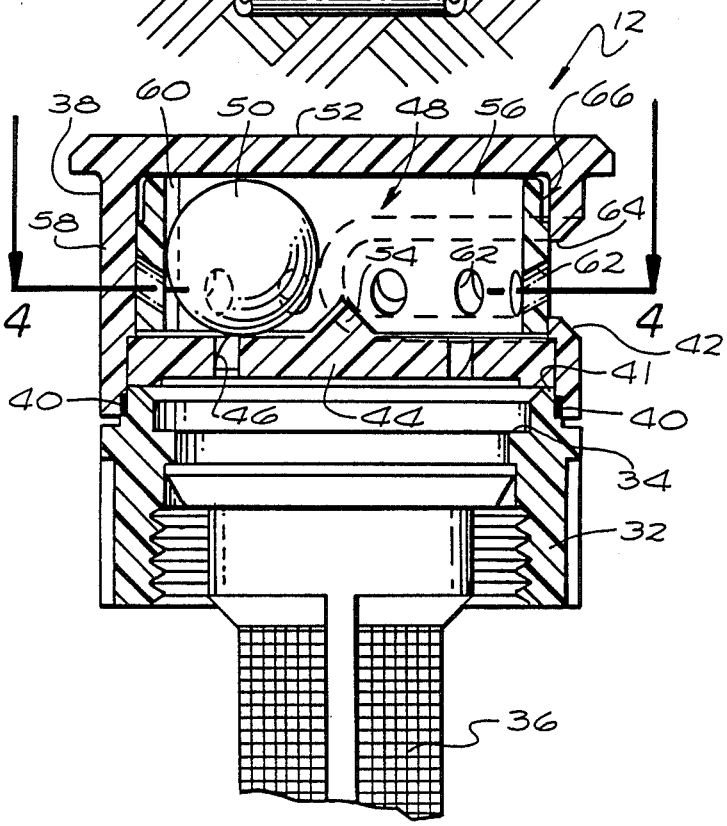
FIG. 3

ROTATING STREAM NOZZLE

BACKGROUND OF THE INVENTION

This invention relates generally to irrigation sprinklers of the type designed to provide one or more outwardly directed irrigation streams which are rotatably swept through a prescribed arcuate path. More particularly, this invention relates to a compact and relatively simple sprinkler nozzle for providing multiple discrete rotating irrigation water streams, wherein the nozzle directly incorporates efficient drive means for indexing the discrete streams in a stepwise manner through a prescribed arcuate spray path.

Irrigation sprinklers are well known of the general type designed to provide one or more outwardly projected streams of irrigation water. Such irrigation sprinklers traditionally include a sprinkler body having one or more spray nozzles mounted thereon, wherein the sprinkler body is rotatable for sweeping the discharged water stream or streams through a prescribed arcuate spray path, such as a part-circle or full-circle path, to irrigate surrounding vegetation. In this regard, the sprinkler further includes a rotary drive mechanism, for example, an impact or reaction drive mechanism which is water-driven to rotate the sprinkler body in a manner delivering the irrigation water over the prescribed spray path. Other types of rotary drive mechanisms include water-driven turbines and drive balls for rotating at least the portion of the sprinkler body carrying the spray nozzle resulting in water distribution over the desired terrain area.

In some specialized irrigation applications, it is desireable to deliver irrigation water to surrounding terrain at a relatively slow precipitation rate primarily to avoid excess water run-off and waste. In addition, it is sometimes desirable to provide such low precipitation rates by use of a relatively small number of irrigation sprinkler devices to correspondingly minimize system cost and complexity including, for example, the required number of sprinkler heads and related piping and controls. To this end, rotating stream sprinklers have been developed to provide multiple dicrete water streams which are projected outwardly with substantial range but at a relatively low flow rate. Such sprinklers have included internal drive mechanisms for rotating the water streams typically in a succession of small steps through a prescribed part-circle or full-circle spray path. However, in the multiple stream rotating sprinklers of this type, the drive mechanisms have been limited to relatively complex and normally bulky turbine drive, ball drive, and/or gear drive structures, thereby rendering such sprinklers relatively costly and unduly complicated in construction. Efforts to provide simplified drive arrangements in sprinklers of this type have generally been unsuccessful due, for example, to the difficulties in obtaining predictable and/or efficient stepwise driving as a result of the complex combination of reaction and rotational forces encountered in such sprinklers.

The improved rotating stream nozzle of the present invention overcomes these problems and disadvantages by providing a compact and simple sprinkler nozzle designed to provide multiple discrete streams rotated through a prescribed arcuate spray path, wherein the sprinkler nozzle directly incorporates a simple yet efficient drive means for stepwise displacement of the discrete water streams.

SUMMARY OF THE INVENTION

In accordance with the invention, an improved rotating stream sprinkler comprises a sprinkler nozzle adapted for mounting onto a water supply conduit such as a water supply riser or the pop-up stem of a pop-up sprinkler or the like. The sprinkler nozzle includes means for providing multiple outwardly projected water streams, in combination with improved drive means incorporated directly into the nozzle for stepwise driving of the streams through a prescribed arcuate spray path.

In accordance with a preferred form of the invention, the improved rotating stream nozzle includes a threaded base adapted for direct mounting onto the end of a water supply conduit. This nozzle base cooperates with and is connected to an overlying nozzle cap to define a relatively small drive chamber, and further to retain a ported swirl plate in a position for passage of water under pressure into the drive chamber with a substantial swirling action. A generally cylindrical rotor is retained within the drive chamber and includes raised anvils on its inner diameter surface. The swirling water flow carries a drive ball within the swirl chamber into successive impact engagement with these anvils to rotate the rotor through a small rotational step within the drive chamber each time the drive ball strikes one of the anvils.

The cylindrical rotor has a plurality of discharge ports formed therein preferably in equiangular spaced relation about the rotor circumference. These rotor discharge ports are rotated, upon stepwise driving of the rotor, through alignment with an open window formed in the nozzle cap for outward projection of the multiple water streams through those discharge ports aligned with the cap window. Importantly, the arcuate size of the cap window determines the prescribed arcuate spray path for irrigation water distribution, for example, ninety degrees, one hundred eighty degrees, etc. Alternately, the cap window may extend circumferentially through a substantially full circle around the nozzle cap, with relatively small support posts projecting between and interconnecting upper and lower cap portions for minimal interference with the outwardly projected water streams. In the full-circle version, adjacent pairs of the discharge ports are beneficially formed in parallel relation to each other, whereby adjacent pairs of the water streams bracket the support posts as the streams are rotated past each post in a manner obtaining substantially optimized irrigation water distribution and range.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented perspective view illustrating a pop-up sprinkler having a rotating stream nozzle embodying the novel features of the invention;

FIG. 2 in an enlarged fragmented vertical sectional view taken generally of the line 2—2 of FIG. 1 and illustrating the pop-up sprinkler in a normal, inoperative position;

FIG. 3 is a further enlarged fragmented vertical sectional view taken generally on the line 3—3 of FIG. 2;

DETAILED DESCRIPTION OF THE PREFERRED EMBODIMENTS

Figure 4:
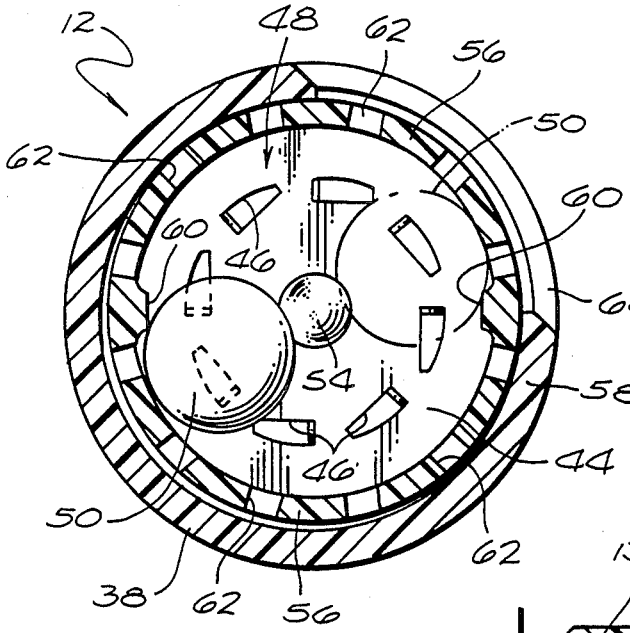
FIG. 4 is a horizontal sectional view taken generally on the line 4—4 of FIG. 3.

As shown in the exemplary drawings, an irrigation sprinkler is referred to generally in FIGS. 1 and 2 by the reference numeral 10 and includes an improved rotating stream nozzle 12. The rotating stream nozzle 12 provides a plurality of outwardly radiated discrete water streams 14 which are driven or indexed in a relatively slow, stepwise manner as indicated by arrow 16 through an arcuate path of predetermined width. The water streams 14 are thus projected over a prescribed terrain area to irrigate surrounding vegetation and the like.

The improved rotating stream nozzle 12 of the present invention advantageously comprises a relatively compact and relatively simple nozzle construction having stepwise rotating driving means incorporated directly into the nozzle. The rotating stream nozzle 12 is designed to provide the multiple water streams 14 at relatively low flow rates and to discharge those streams through a substantial range, thereby providing a relatively low precipitation rate over an extensive terrain area as desired in certain irrigation applications. The spray nozzle 12 is adapted for quick and easy mounting as a self-contained sprinkler unit onto a water supply pipe or conduit, or, in the alternative, the nozzle can be fitted onto a sprinkler unit of a variety of standard designs, such as a pop-up sprinkler assembly. In either case, the improved spray nozzle provides accurate and efficient stepwise driving of the discharged water streams for sweeping motion over the desired terrain area to be irrigated.

As shown in the exemplary embodiment in FIGS. 1 and 2, a conventional irrigation sprinkler 10 is depicted in the form of a pop-up sprinkler assembly having a pop-up stem 18 movable within a sprinkler housing 20 between an upwardly projecting spraying position, as view in FIG. 1, and a normal inoperative position retracted and substantially concealed within the housing 20, as viewed in FIG. 2. The sprinkler housing 20 further includes a threaded lower inlet opening 22 coupled appropriately to a water supply pipe 24 for inflow of water under pressure to the housing, as is well knonw in the art. The pop-up stem 18 is normally biased by a spring 26 to the retracted position (FIG. 2), wherein this spring reacts between the underside of a sprinkler housing cap 28 and an enlarged flange 30 on the pop-up stem. However, when water under pressure is supplied to the inlet opening 22, the water under pressure forces the pop-up stem 18 to displace upwardly with its upper end elevated above the sprinkler housing 20. The rotating stream nozzle 12 of the present invention is mounted on the upper end of the pop-up stem 18 for outward discharge of the multiple water streams 14. Alternately, the nozzle 12 can be mounted upon sprinkler constructions of different types, or, if desired, the nozzle can be mounted directly onto the upper end of a conventional water supply riser pipe or the like.

As shown in detail in FIGS. 3 and 4, the improved rotating stream nozzle 12 comprises a generally cylindrical nozzle base 32 having an internally threaded lower end for mounting onto the upper end of the pop-up stem 18. This nozzle base 32 also includes an internal rim 34 for cooperating with the upper end of the stem to retain a closed-ended tubular strainer or filter 36 which prevents entry of large water-entrained dirt or grit into the nozzle. The upper end of the nozzle base 32 is reduced slightly in diametric size to fit snugly into the lower end of a generally cylindrical nozzle cap 38, wherein both of these components are conventiently formed from a lightweight molded plastic or the like and are securely interconnected, for example, by a sonic weld 40 or other suitable fastener means.

The interconnected nozzle base 32 and cap 34 cooperatively define a pair of annular shoulders 41 and 42 between which is seated a generally circular swirl plate 44. A ring-shaped array of upwardly open and circumferentially angled swirl ports 46 (FIG. 4) is formed in the swirl plate 44. Accordingly, during operation of the nozzle, water flowing upwardly through the nozzle base 32 passes upwardly through the swirl ports 46 which impart a common directional swirling action to the water.

The swirling water flow passing through the swirl ports 46 enters a small drive chamber 48 defined cooperatively by the swirl plate 44 and the nozzle cap 38. The swirling action is applied to a drive ball 50 within the drive chamber 48, wherein the drive ball 50 has a diametric size extending with minimal clearance between the upper face of the swirl plate 44 and the underside of a top wall 52 of the nozzle cap. Accordingly, the swirling water flow forces the drive ball 50 to travel in a circular path within the drive chamber 48. A short central deflector post 54 on the swirl plate 44 prevents the drive ball from hanging up in a centered position within the drive chamber, thus maintaining the drive ball in driven alignment with the water flow discharged through the swirl ports 46.

A cylindrical or annular port 56 of lightweight molded plastic or the like is positioned within the drive chamber 48. The rotor 56 is retained in a position lining the drive chamber periphery by means of an upright side wall 58 of the nozzle cap 38. The inner diameter surface of the rotor includes a plurality of at least two inwardly raised anvils 60, with the illustrative drawings showing two such anvils in diametrically opposed relation to each other. In addition, the rotor 56 defines a plurality of radially outwardly open and upwardly angled discharge ports 62 formed in circumferentially spaced array about the rotor. Importantly, while the rotor 56 is retained within the drive chamber 48, the rotor is free to rotate within the chamber in response to the driving action of the swirling water flow and the drive ball 50.

More specifically, the swirling water flow within the drive chamber 48 carries the drive ball 50 through the circular path, as previously described. This circular motion of the drive ball 50 thus moves the drive ball into impact engagement with one of the anvils 60 on the rotor 56. When the ball impacts the anvil, the impact engagement causes the rotor to displace within the drive chamber through a small rotary step, with the drive ball being formed from metal or the like with sufficient mass to move the rotor through a step of at least several degrees. The drive ball 50 then rides over the impacted anvil 60 and resumes circular water-driven motion within the drive chamber 48 to impact the next anvil in sequence to rotate the rotor through a subsequent rotary step. Accordingly, supply of the water to the nozzle moves the drive ball 50 into repetitious impact engagement with the anvils to rotate the rotor through a succession of small rotary steps.

As the rotor 56 is displaced in a stepwise manner by the drive ball 50, water within the drive chamber 48 is projected outwardly through the rotor discharge ports 62 as the multiple water streams 14. More particularly, as shown best in FIG. 4, the illustrative nozzle cap 38 includes an open window 64 having an arcuate dimension of about ninety degrees. This window 64 is axially aligned with the array of discharge ports 62 in the rotor, whereby multiple ports 62 are exposed through the window at any given point in time to permit outward projection of several water streams 14. The remaining discharge ports are blocked by the side wall 58 of the nozzle cap, resulting in limitation of the water streams to an approximate ninety degree spray path. The discharged water streams 14 are, of course, rotated in a stepwise manner through this prescribed spray path to provide the desired irrigation coverage.

In accordance with primary aspects of the invention, efficient rotary driving of the rotor 56 is obtained by sizing the total open flow area of the swirl ports 46 to be at least slightly greater than the total open flow area defined by the number of discharge ports 62 aligned with the open cap window 64. With this arrangement, sufficient pressure differential is created within the drive chamber 48 to insure efficient and consistent drive ball displacement for rotary drive purposes. In addition, the pressure differential caused sufficient laterally directed forces to occur within the drive chamber to urge the rotor 56 to a slightly off-center position relative to a central axis of the drive chamber, in a direction toward the open window 64. Such urging of the rotor results in sufficient frictional engagement between the rotor and the interior of the nozzle cap to prevent undesired free spinning of the rotor within the cap. The precise magnitude of the frictional forces acting between the rotor and the cap can be controlled by appropriate material selection and, if desired, by slightly relieving the exterior surface of the rotor as indicated at arrow 66 (FIG. 3) to limit surface contact therebetween. Moreover, the rotor 56 is mounted in the drive chamber 48 in a position and manner which substantially avoids axial thrust loading on the rotor, wherein such thrust loading can vary with water supply pressure and thereby result in inefficient or inconsistent stepping movement of the rotor.

The rotating stream nozzle 12 is installed onto the pop-up stem 18 or other water supply conduit with the open window 64 in the nozzle cap 38 opening in the desired direction for irrigation water distribution. Supply of water under pressure to the nozzle rotatably drives the rotor within the nozzle in the stepwise manner, as previously described, to sweep the multiple water streams 14 over the desired terrain area. Except for the rotor 56 and the drive ball 50, the remaining portions of the the nozzle do not move during nozzle operation.

Figure 5:
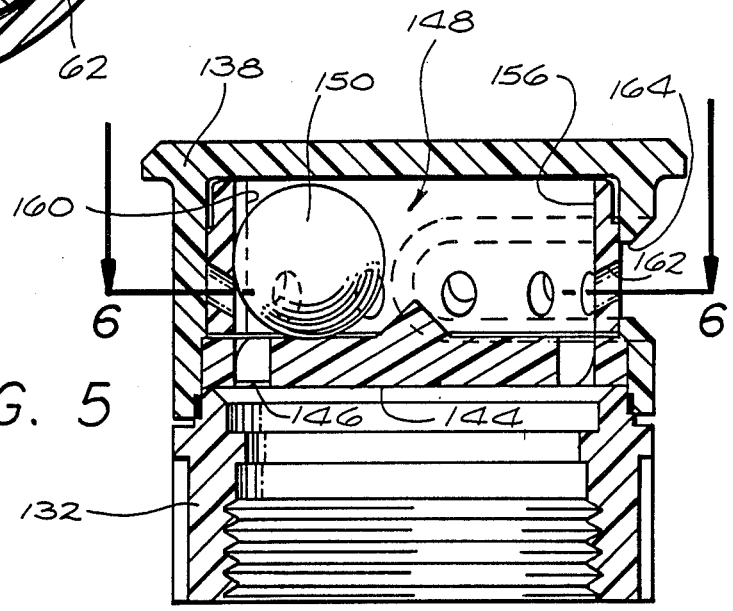
FIG. 5 is an enlarged fragmented vertical sectional view similar to FIG. 3 but illustrating an alternative preferred form of the invention.
Figure 6:
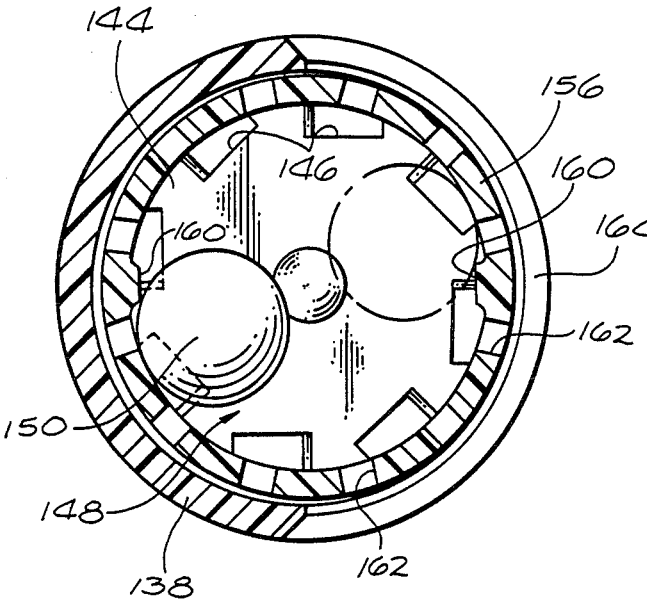
FIG. 6 is a horizontal sectional view taken generally on the line 6—6 of FIG. 5.

An alternative form of the invention is depicted in FIGS. 5 and 6, wherein the nozzle is modified to provide an arcuate spray path having a magnitude of about one hundred eighty degrees. More specifically, in this embodiment, a nozzle base 132 constructed as previously described with respect to FIGS. 1–4 is fitted into the lower end of a modified nozzle cap 138, wherein the cap 138 corresponds with the cap 38 described in FIGS. 1–4 except that the cap 138 includes an open window 164 extending through an arcuate range of about one hundred eighty degrees. The nozzle cap 138 and the base 132 cooperatively support a swirl plate 144 having a series of upwardly open and circumferentially angled swirl ports 146. As in the previous embodiment, these swirl ports 146 collectively provide a total flow area at least slightly greater than the total area of discharge ports 162 formed in a rotor 156 and aligned with the cap window 164, wherein the rotor is positioned within a drive chamber 148 overlying the swirl plate 144.

In operation of the embodiment of FIGS. 5 and 6, water under pressure is supplied through the swirl plate 144 with a swirling action into the drive chamber 148 to correspondingly displace a drive ball 150 therein. The drive ball impacts internal anvils 160 on the rotor 156 to displace the rotor through a series of small rotational steps. At the same time, water within the drive chamber 148 is discharged from the nozzle through a plurality of the discharge ports 162 aligned with the open window 164 in the nozzle cap.

Figure 7:
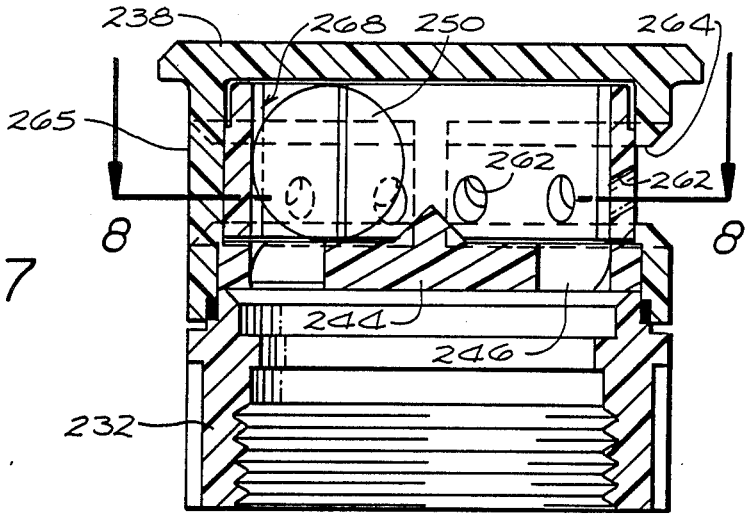
FIG. 7 is an enlarged fragmented vertical sectional view similar to FIG. 3 but illustrating still another alternative preferred form of the invention.
Figure 8:
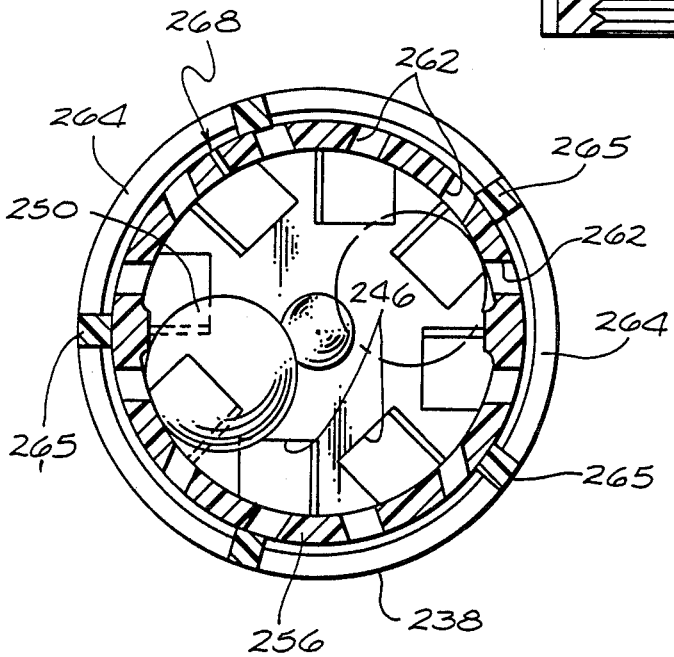
FIG. 8 is a horizontal sectional view taken generally on the line 8—8 of FIG. 7.
Figure 9:
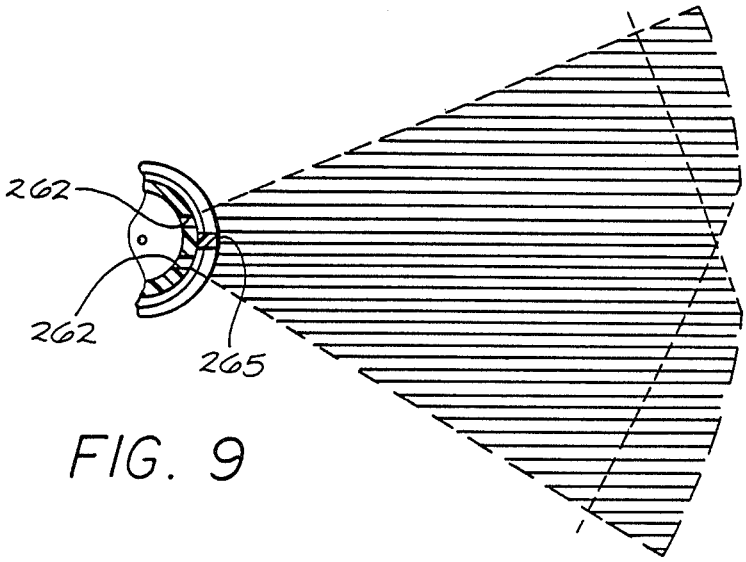
FIG. 9 is a somewhat diagrammatic view illustrating operation and spray pattern distribution of the rotating stream nozzle of FIGS. 7 and 8.

Another alternative form of the invention is depicted in FIGS. 7–9, wherein the nozzle is further modified to accommodate substantially full circle water distribution over surrounding terrain. More specifically, in this version of the invention, a nozzle base 232 of the type described previously is secured to the lower end of a modified nozzle cap 238 having a substantially full-circle open window 264 interrupted only by relatively narrow support posts 265 interconnecting upper and lower portions of the cap. This open window 264 permits substantially uninterrupted outward projection of water streams from an internal rotor 256 having a plurality of discharge ports 262. As in the previously described embodiments of the nozzle, the rotor is driven in a stepwise manner by a drive ball 250, and the discharge ports 262 aligned with the window 264 collectively provide a total area at least slightly less than that total area provided by swirl ports 246 in a swirl plate 244. In addition, in this embodiment, the rotor 256 is advantageously split, an indicated by arrow 268 (FIG. 8), whereby water pressure within the drive chamber urges the rotor to expand radially into sufficient frictional contact with the nozzle cap to prevent free rotor spinning within the drive chamber.

Further enhancement in the irrigation water distribution pattern in the nozzle of FIGS. 7–9 is obtained by arranging the rotor discharge ports 262 in a pattern and number relative to the support posts 265 to prevent undue blockage of the water streams by the support posts. More specifically, the relative numbers of the ports 262 and the support posts 265 are chosen to permit blockage of a minimum number of the ports 262 at any given point in time, such as by utilizing an even number of symmetrically arranged ports relative to an odd number of symmetrically arranged supports posts. Still further distribution improvements are obtained by forming the discharge ports 262 in an even number of parallel pairs which are spaced to bracket each support post 265 when the posts are rotated past the post, as viewed best in FIG. 9. With this configuration, the distribution patterns of water discharged from the parallel pairs of ports cooperate to provide optimum range of distribution, with minimal reduction in range in the vicinity of each support post.

Accordingly, the improved rotating stream nozzle of the present invention is provided for quick and easy installation onto a water supply pipe such as a riser, pop-up stem of the like for use in irrigation. The rotor comprises a compact device with internal drive means for accurate and consistent drive through a wide range of water supply pressures. Moreover, the rotating stream nozzle can be adapted in various constructions for part-circle or full-circle irrigation water coverage, as desired.

A variety of further features and modifications to the invention described herein will be apparent to those skilled in the art. Accordingly, no limitation is intended by way of the description and drawings, except as set forth in the appended claims.

What is claimed is:

1. A rotating stream nozzle for connection to a water supply conduit, said nozzle comprising:

a downwardly open nozzle cap defined by a substantially closed upper end wall, and a generally upright side wall having an outwardly open window of predetermined width formed therein;

a swirl plate mounted on said cap in generally spaced relation with said upper end wall and cooperating with said upper end wall and said side wall to define a drive chamber, said swirl plate having a plurality of angularly inclined swirl ports formed therein for passage of water therethrough into said drive chamber with a substantial annular swirling action;

means for mounting said nozzle cap and said swirl plate onto the water supply conduit for passage of water through said swirl ports into said drive chamber;

a generally cylindrical rotor supported for rotation substantially without axial displacement within said drive chamber, said rotor having a plurality of outwardly open discharge ports formed therein with at least some of said discharge ports aligned with said open window irrespective of the rotational position of said rotor within said drive chamber, said rotor further including an inner diameter surface having a plurality of raised anvils formed thereon; and a drive ball within said drive chamber, said drive ball having a size and mass for displacement by swirling water within said drive chamber to carry said drive ball into repetitious impact engagement with said anvils to index said rotor through a rotational step within said drive chamber upon each impact of said drive ball with one of said anvils;

the ones of said discharge ports in said rotor in alignment with said window permitting outward discharge passage of water from said drive chamber as multiple water streams distribution over a prescribed arcuate path defined by the width of said window.

2. The rotating stream nozzle of claim 1 wherein said window has a width defining a prescribed arcuate path of about ninety degrees.

3. The rotating stream nozzle of claim 1 wherein said window has a width defining a prescribed arcuate path of about one hundred eighty degrees.

4. The rotating stream nozzle of claim 1 wherein said cap includes upper and lower portions interconnected by a plurality of relatively narrow support posts, said supports posts cooperating with said upper and lower portions to define said window having a width providing a substantially full-circle arcuate path.

5. The rotating stream nozzle of claim 4 wherein said cap includes an odd number of said support posts disposed in a generally symmetric arrangement about said cap, and wherein said rotor includes an even number of said discharge ports disposed in a generally symmetric arrangement about said rotor.

6. The rotating stream nozzle of claim 5 wherein said discharge ports in said rotor are formed in generally parallel pairs.

7. The rotating stream nozzle of claim 1 wherein said rotor comprises a split cylinder.

8. The rotating stream nozzle of claim 1 further including a central post within said drive chamber to prevent movement of said drive ball to a generally axially centered position within said drive chamber.

9. The rotating stream nozzle of claim 1 wherein said swirl ports formed in said swirl plate collectively define an open flow area at least slightly greater than the open flow area provided by said ones of said rotor discharge ports aligned with said cap window.

10. The rotating stream nozzle of claim 1 wherein said rotor includes an outer diameter surface for engagement with said nozzle cap, a portion of said outer diameter surface being relieved for spaced relation with respect to said nozzle cap.

11. The rotating stream nozzle of claim 1 wherein said mounting means comprises a threaded base connected to said nozzle cap, said base and said nozzle cap including spaced shoulder menas for cooperating to retain said swirl plate.

12. The rotating stream nozzle of claim 1 wherein said rotor is substantially open ended.

13. A rotating stream nozzle for connection to a water supply conduit, said nozzle comprising:

a nozzle cap having an outwardly open window of predetermined width formed therein, said nozzle cap defining an internal drive chamber;

a generally cylindrical rotor supported for rotation substantially without axial displacement within said drive chamber and having a plurality of outwardly open discharge ports formed therein, said discharge ports being rotatable in sequence into alignment with said cap window upon rotation of said rotor within said drive chamber, said rotor having an inner diameter surface;

means forming at least one anvil on said inner diameter surface of said rotor;

means for connecting said nozzle cap to the water supply conduit for flow of water under pressure into said drive chamber with a substantial annular directional action; within said rotor; and a drive ball within said drive chamber, said drive ball having a size and mass for displacement by the swirling water within said drive chamber to carry said drive ball into repetitious impact engagement with said anvil to index said rotor through a succession of rotational steps within said drive chamber, said discharge ports upon alignment with said window permitting outward discharge of water from said drive chamber as outwardly projected water streams rotated in steps through a prescribed arcuate path defined by the width of said window.

14. The rotating stream nozzle of claim 13 wherein said means forming at least one anvil within said rotor comprises a plurality of generally symmetrically arranged anvils.

15. The rotating stream nozzle of claim 13 wherein a plurality of said rotor discharge ports are aligned with said cap window irrespective of the rotational position of said rotor within said drive chamber.

16. The rotating stream nozzle of claim 13 further including a central post withn said drive chamber to prevent movement of said drive ball to a generally axially centered position within said drive chamber.

17. The rotating stream nozzle of claim 13 wherein said connecting means defines an open flow area for passage of water into said drive chamber, said open flow area being at least slightly greater than the flow area provided by the number of said rotor discharge ports in alignment with said cap window.

18. A rotating stream nozzle for connection to a water supply conduit, said nozzle comprising:

a nozzle cap having an outwardly open window of predetermined width formed therein;

a nozzle base connected to said cap and including means adapted for connection to the water supply conduit;

a swirl plate retained generally between said nozzle cap and said nozzle base and cooperating with said nozzle cap to define a relatively small drive chamber, said swirl plate having an array of angularly set swirl ports formed therein for passage of water under pressure into said drive chamber with a substantial annular swirling action;

a generally cylindrical rotor supported within said drive chamber for rotation within said nozzle cap substantially without axial displacement within said drive chamber, said rotor having a plurality. of outwardly open discharge ports formed therein in positions for sequential alignment of a plurality of said discharge ports with said cap window upon rotation of said rotor within said drive chamber, said rotor further including an inner diameter surface with at least two generally symmetrically arranged anvils formed thereon;

a drive ball within said drive chamber and having a size and mass for rotational displacement by the swirling water action to carry said drive ball into repetitious impact engagement with said anvils to rotate said rotor through a rotational step upon each such impact; and post means within said drive chamber for preventing movement of said drive ball to an axially centered position within said drive chamber;

said plurality of said discharge ports being rotated in steps with said rotor relative to said nozzle cap and permitting outward discharge of multiple water streams from said drive chamber, said streams being distributed over a prescribed arcuate path defined by the width of said cap window.

19. The rotating stream nozzle of claim 18 wherein said cap includes upper and lower portions interconnected by a plurality of relatively narrow support posts, said support posts cooperating with said upper and lower portions to define said window having a width providing a substantially full-circle arcuate path.

20. The rotating stream nozzle of claim 19 wherein said cap includes an odd number of said support posts disposed in a generally symmetric arrangement about said cap, and wherein said rotor includes an even number of said discharge ports disposed in a generally symmetric arrangement about said rotor.

21. The rotating stream nozzle of claim 20 wherein said discharge ports in said rotor are formed in generally parallel pairs.

22. The rotating stream nozzle of claim 18 wherein said rotor comprises a split cylinder.

23. The rotating stream nozzle of claim 18 wherein said swirl ports formed in said swirl plate collectively define an open flow area at least slightly greater than the open flow area provided by said ones of said rotor discharge ports aligned with said cap window.

24. A rotating stream nozzle for connection to a water supply conduit, said nozzle comprising:

a nozzle cap having an outwardly open window formed therein of predetermined width, said nozzle cap defining an internal drive chamber;

a generally cylindrical rotor supported for rotation substantially without axial displacement within said drive chamber and having a plurality of outwardly open discharge ports formed therein, said discharge ports being rotatable in sequence into alignment with said cap window upon rotation of said rotor within said drive chamber;

means forming at least one anvil within said rotor;

means for connecting said nozzle cap to the water supply conduit for flow of water under pressure into said drive chamber with a substantial annular swirling action; and drive means within said drive chamber and driven by water flowing with swirling action into said drive chamber for impacting said anvil to rotate said rotor in a succession of rotational steps relative to said nozzle cap, said discharge ports upon alignment with said window permitting outward discharge of water from said drive chamber as outwardly projected water streams rotated in steps through a prescribed arcuate path defined by the width of said cap window.

25. A rotating stream nozzle for connection to a supply of water under pressure, said nozzle comprising:

a nozzle cap defining a generally cylindrical drive chamber and having a generally radially outwardly open window of predetermined arcuate width;

a generally cylindrical rotor supported for rotation within said drive chamber in a position covering said open window, said rotor having a plurality of outwardly open discharge ports formed therein for movement in sequence into alignment with said open window upon rotation of said rotor within said drive chamber;

means forming at least one anvil within said rotor;

means for supplying a substantial annularly swirling water flow into said drive chamber within said rotor substantially without applying an axially directed thrust load to said rotor; and driven means within said drive chamber and driven by said swirling water flow to impact said anvil means for rotating said rotor in a succession of rotational steps within said drive chamber, said rotor ports upon alignment with said open window permitting outward discharge of water from said drive chamber as outwardly directed water streams rotated in steps through a prescribed arcuate path defined by the arcuate width of said open window.

26. A rotating stream nozzle for connection to a supply of water pressure, said nozzle comprising:

a nozzle cap defining a drive chamber and having an outwardly open window of predetermined width;

a generally cylindrical rotor having a plurality of outwardly open discharge ports;

means for mounting said rotor for rotation within said drive chamber with said rotor covering said window irrespective of the rotational position of said rotor, whereby said rotor upon rotation displaces said ports into sequential alignment with said window;

driven means within said rotor for rotating said rotor within said drive chamber upon supply of water under pressure into said drive chamber; and means for supplying water under pressure into said drive chamber to drive said driven means, said driven means being disposed substantially coplanar with said rotor discharge ports and said open window.

27. A rotating stream nozzle for connection to a supply of water under pressure, said nozzle comprising:

cap means defining a generally cylindrical drive chamber having a generally radially outwardly open window of predetermined arcuate width;

a generally cylindrical rotor within said drive chamber and having a circumferential array of outwardly open discharge ports formed therein, said rotor being mounted for rotation with at least some radial floating within said drive chamber, said rotor covering said window;

driven means for rotating said rotor within said drive chamber to correspondingly rotate said discharge ports in sequence into alignment with said window; and means for supplying water under pressure into said drive chamber for outward discharge as rotating water streams through said discharge ports when said discharge ports are aligned with said open window, said rotor responding to the supply of water under pressure therein to float radially into substantial sealing engagement with said cap means about said open window, such that said outwardly directed water streams are confined to passage through said ports aligned with said window.

28. In an irrigation sprinkler nozzle of the type having a generally cylindrical nozzle cap defined by a generally cylindrical upright side wall and a substantially closed upper end wall, and an open lower end adapted for stationary mounting onto a water supply conduit, said side wall having a generally radially outwardly open window formed therein of predetermined arcuate width, the improvement comprising:

a swirl plate carried by said cap in spaced relation below said upper end wall and cooperating with said cap to define a drive chamber, said swirl plate having a plurality of angularly inclined swirl ports formed therein for passage of water from said water supply conduit into said drive chamber with a substantial annular swirling action within said drive chamber;

a generally cylindrical and substantially open-ended rotor disposed within said drive chamber in a position lining said cylindrical side wall, said cap and said swirl plate substantially restraining said rotor against axial displacement within said drive chamber, said rotor being rotatable and supported for at least some radial floating within said drive chamber, said rotor having a plurality of generally radially outwardly open discharge ports formed therein with at least one of said discharge ports being aligned with said window irrespective of the rotational position of said rotor, said rotor further having an inner diameter surface with an anvil formed thereon; and a drive ball within said drive chamber, said drive ball having a size and mass for displacement by swirling water within said drive chamber to carry said drive ball into repetitious impact engagement with said anvil to index said rotor through a rotational step within said drive chamber upon each impact of said drive ball said anvil;

the ones of said discharge ports in said rotor in alignment with said window permitting outward discharge passage of water from said drive chamber as multiple water streams distributed over a predetermined arcuate path defined by the width of said window.

* * * * *

UNITED STATES PATENT AND TRADEMARK OFFICE

CERTIFICATE OF CORRECTION

PATENT NO. : 4,781,328

DATED : November 1, 1988

INVENTOR(S) : Robertson, David E.

It is certified that error appears in the above-identified patent and that said Letters Patent is hereby corrected as shown below:

In the Detailed Description of the Preferred Embodiments:

Column 3, line 58, delete [view] and insert viewed

Column 3, line 63, delete [knonw] and insert known

Column 4, line 51, delete [port] and insert rotor

Column 6, line 50, delete [that] and insert the

Column 6, line 68, delete [supports] and insert support

Claim 4, line 10, delete [supports] and insert support

Claim 11, line 41, delete [menas] and insert means

Claim 13, line 63, after "action", delete ['']

Claim 16, line 16, delete [withn] and insert [within]

Signed and Sealed this

Twenty-eighth Day of March, 1989

*Attest:*

DONALD J. QUIGG

*Attesting Officer*

*Commissioner of Patents and Trademarks*